United States Patent [19]

Horst

[11] Patent Number: 4,704,973

[45] Date of Patent: Nov. 10, 1987

[54] BOOKBINDING METHOD AND APPARATUS

[75] Inventor: Rathert Horst, Minden, Fed. Rep. of Germany

[73] Assignee: Kolbus GmbH & Co. KG, Rahden, Fed. Rep. of Germany

[21] Appl. No.: 884,953

[22] Filed: Jul. 14, 1986

[30] Foreign Application Priority Data

Jul. 15, 1985 [DE] Fed. Rep. of Germany ..... 3525185

[51] Int. Cl.[4] ..... B42B 2/04

[52] U.S. Cl. ..... 112/21; 112/262.3; 112/304; 412/35

[58] Field of Search ..... 412/35; 112/304, 21, 112/22, 262.3

[56] References Cited

U.S. PATENT DOCUMENTS

| | | | |
|---|---|---|---|
| 3,782,306 | 1/1974 | Bosshard | 112/21 |
| 3,797,419 | 3/1974 | Depetris | 112/21 |
| 3,797,421 | 3/1974 | Sanderson | 112/21 |
| 4,252,071 | 2/1981 | Rathert et al. | 112/21 |

FOREIGN PATENT DOCUMENTS

| | | |
|---|---|---|
| 490481 | 1/1930 | Fed. Rep. of Germany . |
| 3325173 | 1/1984 | Fed. Rep. of Germany . |

*Primary Examiner*—Werner H. Schroeder
*Assistant Examiner*—Andrew M. Falik
*Attorney, Agent, or Firm*—Chilton, Alix & Van Kirk

[57] ABSTRACT

A sewing-press for thread-sewing book blocks which are formed from individual book block sections comprises an endless conveyor which transports the block sections into registration with a sewing head. The conveyor includes sewing saddles which support the block sections during sewing, the saddles being articulated to a continuously moving chain so as to have a dwell phase in the sewing region. The sewing needles, after punching the sewing thread through the block section, pivot to directly transfer the thread to the cooperating hook needles which, in turn, draw the thread back through the block section in the form of a loop which is linked to a loop on the preceding block section.

21 Claims, 7 Drawing Figures

BOOKBINDING METHOD AND APPARATUS

BACKGROUND OF THE INVENTION (1) Field of the Invention

The present invention relates to the manufacture of books and particularly to the joining together of book block sections by sewing. More specifically, this invention is directed to apparatus for thread-sewing book blocks which are formed from individual book block sections and especially to an improved sewing-press for bookbinding. Accordingly, the general objects of the present invention are to provide new and improved methods and apparatus of such character.

(2) Description of the Prior Art

It is known to form books, particularly books of high quality, by sewing individual book block sections together. In one prior procedure, a book block section or signature is spread open in a tent-like position. Steel needles then punch through the center fold of the section. Reciprocal hooks, which have also been thrust through the block section, catch the threads carried by the needles and thereby form loops of thread which are withdrawn from the section and linked with the loops of the next preceding block section. In this way the block sections are sewn together with a series of continuous threads which define chain stitches. The apparatus for practicing this prior technique includes a sewing head, an oscillating sewing saddle which feeds the individual block sections to the sewing head, and a delivery table for discharging the sewn sections.

The prior art apparatus, as briefly described above, has been characterized by mechanical complexity and thus relatively high cost and less than ideal reliability. This complexity has resulted from the necessity of imparting oscillatory motion to the sewing saddle, the need to impart swinging motion to feed rollers, the requirement that pressure be applied to the fold of the block sections, and the need to employ thread pushers to transfer the thread from the needles to the hooks. Additionally, the prior apparatus required moveable pre-piercing needles and relatively complex book block section holding mechanisms.

SUMMARY OF THE INVENTION

The present invention overcomes the above-discussed and other deficiencies and disadvantages of the prior art by providing a novel and improved sewing process especially well suited for use in the joining of book block sections. The invention also encompasses a novel sewing-press for bookbinding. The present method and apparatus are characterized by greatly enhanced operational speed, reduced cost and increased reliability when compared to the prior art.

In accordance with the preferred embodiment, the sewing press of the invention comprises a sewing head, for executing the chain stitches which interconnect the individual block sections, and an endless conveyor. A plurality of movable, spaced apart sewing saddles are supported from the conveyor. The supports for the saddles are hinge-like mechanisms which allow the dwell time during which the sewing operation occurs to be maximized. The saddles are moved from the position in which they acquire the book block sections to a position within the operating area of the sewing head. After the sewing operation, the saddles are disengaged from, i.e., moved out of, the block sections and returned to a starting position.

The process of the present invention, and the preferred apparatus embodiment, provides for the direct transfer of the sewing threads from the needles to the hooks once the sewing needles have punched through the fold of the block section.

The apparatus and method of the invention have the capability of operating at a considerably increased speed, for example twice the speed, when compared to the prior art without any increase in needle speed. The increase in speed results from the fact that the dwell time for the sewing operation is more than twice as long as available in the prior art.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE DISCLOSED EMBODIMENT

Figure 1:
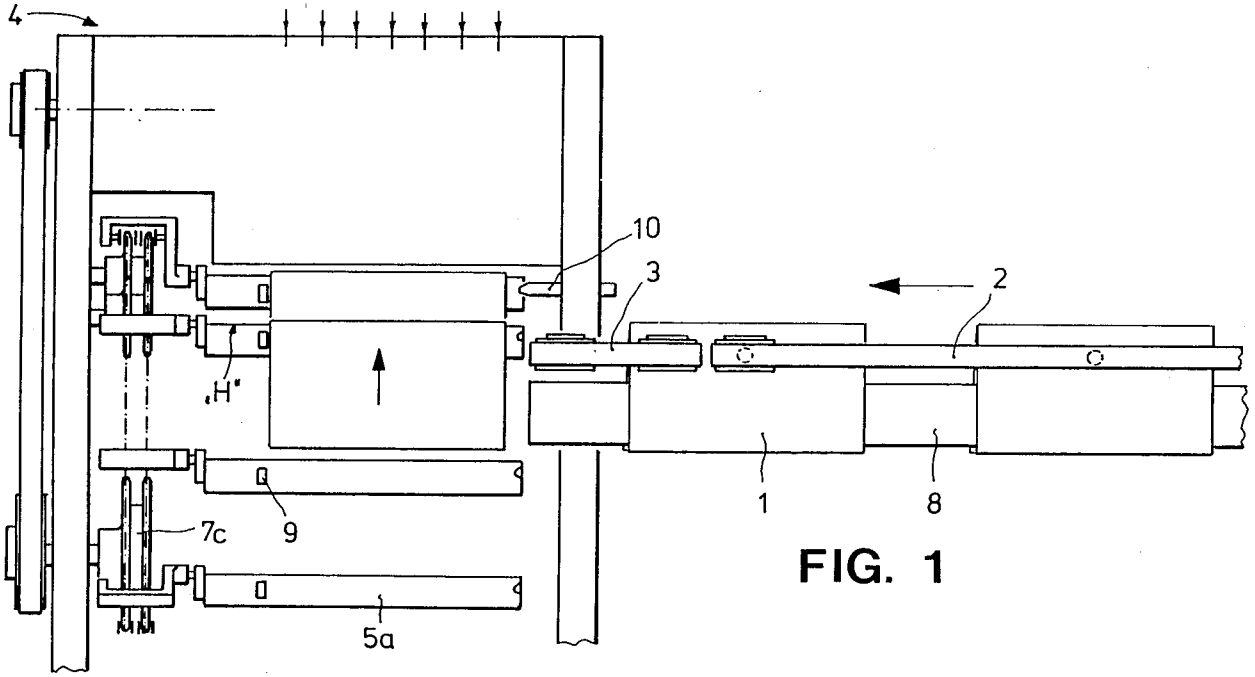
FIG. 1 is a schematic front view of a sewing-press in accordance with a first embodiment of the invention.
Figure 2:
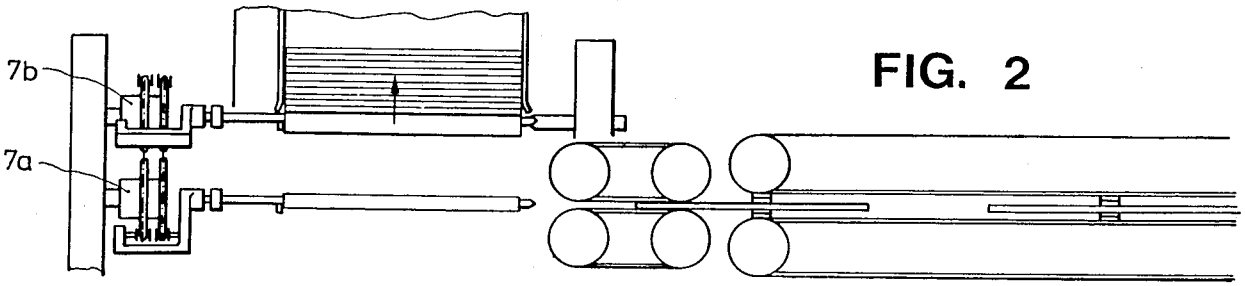
FIG. 2 is a plan view of the apparatus of FIG. 1.
Figure 3:
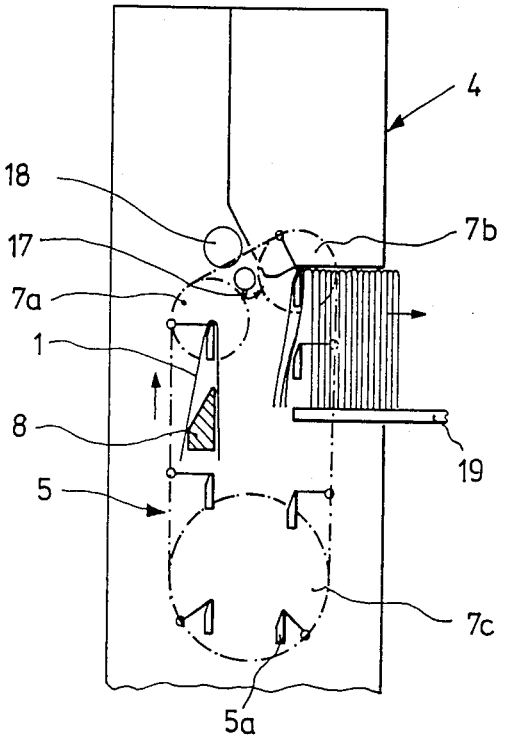
FIG. 3 is a side view of the apparatus of FIGS. 1 and 2.
Figure 5:
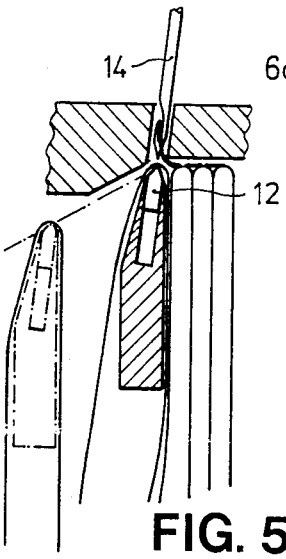
FIG. 5 is a cross-sectional view taken along line V—V of FIG. 4.

Referring now to the drawing, a book block to be formed is comprised of individual block sections 1 which are delivered to the sewing-press via a conveyor system. The block sections are conveyed in an open, i.e., inverted tent-like condition having been opened by means of a section opener, not shown. The conveyor system includes a delivery belt 2 and a short intermediate belt 3 which forms a continuation of belt 2. A stationary saddle 8 extends along belts 2 and 3 for the purpose of maintaining the open condition of the book block sections. As will be explained in greater detail below, at the sewing-press sewing needles 13 (FIG. 4) punch a sewing thread through the fold of the block sections, one section being operated upon at a time. The thread, after being punched through the block section fold, is transferred to a hook needle 14 which draws the thread, in the form of a loop, out of the section. The withdraw loop is then linked with a loop formed on the preceding block section in the manner known in the art.

The sewing-press of the present invention comprises a sewing head 4 and an endless conveyor 5. The endless conveyor 5 includes a chain drive which comprises sprockets *7a*, *7b* and *7c*. A plurality of sewing saddles 5*a* are suspended from the chain of conveyor 5 by means of hinged, i.e., articulated, supports which are shown schematically. The saddles 5*a* are spaced from one another and move, in succession, from a position where they acquire an individual book block section from the stationary saddle 8 to a position within the operating area of sewing head 4. Because of the manner in which they are linked to the conveyor 5, as will be further discussed below, the movement of the saddles 5*a* is arrested when they are in the sewing head operating area. After the book block section 1 which is being carried thereby is linked to the preceding block section 1, a saddle 5*a* will continue to move with the conveyor 5 and will move out of the block section and will return to a starting position. The endless conveyor 5 is essentially located in a vertical plane of movement and the sewing saddles 5*a* arrive at an upper reversal position, beneath the sewing head 4, and then are retracted from the individual block sections. The motion in the retraction direction is in vertical direction and takes place after the block section 1 has been linked to a preceding section.

Figure 7:
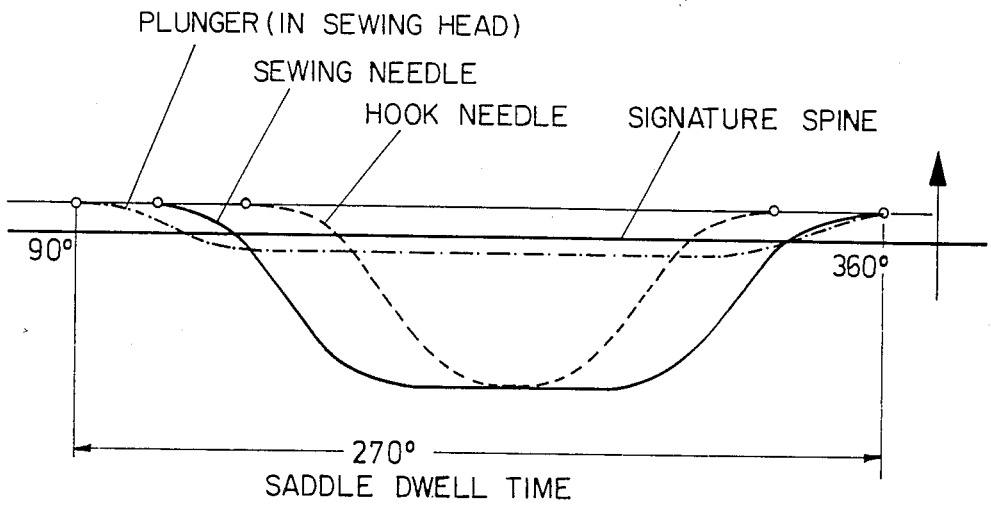
FIG. 7 is a timing diagram which depicts the sequence of movements of the disclosed embodiment.

As noted above, the saddles 5*a* are articulated to the conveyor 5 in a manner where they are offset inwardly with respect to the conveyor. This results in a dwell time occurring between the termination of upward movement of the saddles and the beginning of their movement in the retraction direction. This dwell time corresponds in the disclosed embodiment to a 270 degree portion of the operating cycle of the sewing head 4. Restated, in the operation of the sewing head there is a dwell time of the sewing saddles which occupies more than half of the total time during which a block section supported on a saddle is clamped for sewing. The operating cycle of the sewing head 4 is graphically represented in FIG. 7. The conveyor 5, of course, continues to run during the dwell time of the individual saddles 5*a*. During its dwell time, a saddle will be located adjacent a needle rail 6 of the sewing head 4 and the block section will be pressed against the saddle so as to be clamped during sewing. During their vertical downward movement, the saddles 5*a* laterally support the sections 1 which have been sewn together and are vertically supported on a delivery table 19.

In the lower region of the path of travel defined by the conveyor 5, the direction of movement of the sewing saddles 5*a* is reversed by the large sprocket wheel 7*c*. The book block sections 1 delivered to the endless conveyor 5 by the intermediate belt 3 are, as noted above, held open by the stationary saddle 8. Each section 1 serially received via belt 3 is guided on to a saddle 5*a* as soon as the saddle 5*a* has been translated into registration with the stationary saddle 8. By the time each book block section 1 has been conveyed into the region occupied by a sewing saddle 5*a* to the full section length, as defined by a book block format, the saddle will have reached the position indicated at "H" in FIG. 1. At this position, the spine of the book block section is fully inserted and the section rests entirely on the saddle 5*a*. During the transfer of a block section 1 onto a saddle 5*a* it is prevented from falling over by a clamping action exerted by the intermediate belt 3.

As the movement of a block section 1 continues from position "H", the section will contact stops which may be set in accordance with the book block format. The sewing saddles 5*a* are mechanically located in their upper dwell position by means of a centering piece 10. The position of the block sections 1 relative to the sewing head may be adjusted such that the stitch pattern lies symmetrically within the block format.

An important difference between the present invention and the prior art resides in the fact that the present invention does not require the use of pre-piercing needles or the use of thread pushers and grippers. The prior art required both of these devices and further dictated that they be installed within the moving sewing saddle. This added considerable complexity to the drive mechanism for the saddles and resulted in a high susceptibility to failure.

The sewing saddles 5*a* of the present invention are each provided with a narrow longitudinal slot 5*b*. Inserts 12 are positioned in slots 5*b*. The inserts 12 terminate in a sharp outer edge and serve to center the spines of the book block sections. A plunger 15 is located in the sewing head 4 between each of the plural sewing needles 13 and the associated each hook needle 14. The plungers 15 compress the book block section spines in the region close to the needles and thus enable the needles to pierce the spine centrally and in a functionally reliable manner.

The hook needles 14 function in the known manner, executing reciprocating and rotary movements.

Figure 4:
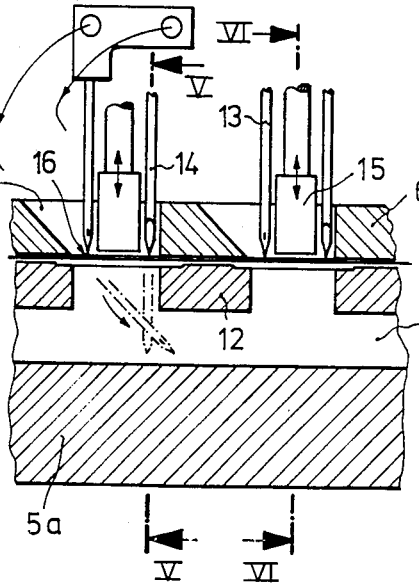
FIG. 4 is an enlarged view of a needle and plunger subassembly for use in a sewing-press in accordance with the invention.
Figure 6:
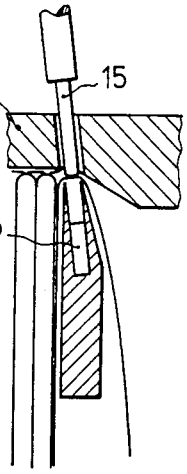
FIG. 6 is a cross-sectional view taken along line VI—VI of FIG. 4.

The sewing needles 13 swing during their stroke, as indicated schematically in FIG. 4, and thus directly transfer the thread to the hook needles 14. This enables the elimination of the thread pushers of the prior art. The swinging movement of the sewing needles 13 is controlled by means of a cam such that the position, indicated at 16, at which the needle passes through the spine of the book block section 1 remains constant during the needle stroke, i.e., the block section is not torn. The thread feeding arrangements employed in the practice of the present invention are the same as utilized in the prior art and the thread is cut in the known manner by means of stationary cutting needles, the cut being made in the blank stitch.

The gluing of the front and back of the book block sections takes place in the portion of the transport path immediately in advance of the dwell position. The gluing is effected by means of a rotatable paste strip 17 which acquires adhesive from a transfer roller 18.

The sewn book blocks are discharged from the sewing-press via the delivery table 19 in the known manner.

While a preferred embodiment has been shown and described, various modifications and substitutions may be made thereto without departing from the spirit of the invention. Accordingly, it is to be understood that the present invention has been described by way of illustration and not limitation.

What is claimed is:

1. In a sewing-press for thread-sewing book blocks which are formed from individual book block sections, the sewing-press including a sewing head and a sewing saddle, the sewing saddle feeding individual book block sections to the operating area of the sewing head, the sewing-press further including a delivery table for discharging the sewn book blocks, the sewing-press sewing head having at least a first hook needle and an associated sewing needle, the sewing needle punching an aperture through the fold of each individual book block section during the time the block section is in the said sewing head operating area, the thread being carried through the aperture by the sewing needle and thereafter being transferred to the hook needle, the hook needle also being punched through the fold of each individual book block section at a distance from the sewing needle in the said sewing head operating area, the hook needle leading the thread which has been carried through the aperture formed by the sewing needle out of the block section in the form of a loop and linking the loop to a thread loop previously formed on a next preceeding block section whereby the sewing head produces chain stitches which link the individual book block sections, the improvement comprising an endless conveyor which defines a path, drive means for imparting motion to said conveyor, a plurality of sewing saddles, articulated support means for individually suspending the sewing saddles from said conveyor, the sewing saddles being spaced from one another and being moveable from a starting position to a position for acquiring the individual book block sections and thence to a position within the operating area of the sewing head, the sewing saddles subsequently being moved back into the starting position.

2. The apparatus of claim 1 wherein the endless conveyor defines an essentially vertical plane of movement, the sewing saddles being moved into a upper reversal position beneath the sewing head in the said operating area, the saddles subsequently being moved vertically out of the individual book block sections, the block sections which have been sewn together being laterally supported during movement of the saddles out of the block sections, said saddle movement out of the block sections occurring after the linking of a block section with a preceding section has been effected.

3. The apparatus of claim 2 wherein the endless conveyor circulates continuouly and the support means for the sewing saddles offset said sewing saddles inwardly with respect to the continuous path defined by said conveyor, the articulation of the sewing saddles to the conveyor producing a dwell in the movement of the sewing saddles when they reach their upper reversal position in the operating area of the sewing head.

4. The apparatus of claim 3 further comprising needle drive means for imparting pivoting motion to the said at least first sewing needle, said needle drive means causing the direction of movement of the said at least first sewing needdle to change when the said needle is within the aperture formed in the block sections by the said at least first sewing needle, the pivoting motion being in the direction of the associated hook needle.

5. The apparatus of claim 1 further comprising a conveying apparatus which is installed upstream of the endless conveyor in the direction of book block section travel, the said conveying apparatus comprising conveying belts which both grip the bookblock sections in the region of the fold and transport the block sections, the conveying apparatus further comprising a stationary saddle which is located below the belts and keeps the opened block sections spread apart so that they can be transferred onto the sewing saddles.

6. The apparatus of claim 1 wherein the sewing saddles each define a block section support plane and wherein the movement of the endless conveyor is planar and substantially perpendicular to the planes defined by the sewing saddles, said sewing saddle defined planes lying outside of the said endless conveyor movement path.

7. The apparatus of claim 1 further comprising centering means for defining the location of the sewing saddles when the said saddles are in the upper reversal position beneath the sewing head in the said head operating area.

8. The apparatus of claim 1 further comprising adjustable stops on said sewing saddles for positioning the book block sections laterally with respect to said sewing saddles.

9. The apparatus of claim 1 wherein the sewing head includes plural pairs of sewing needles and associatod hook needles, said apparatus further comprising sewing needle drive means for imparting pivoting motion to the sewing needles said sewing needle drive means causing the direction of movement of the needles to change when the needles are within the apertures formed in the block section by the needles, the pivoting motion being in direction of the associated book needles.

10. The apparatus of claim 1 wherein the sewing head includes plural pairs of sewing needles and associated hook needles, said apparatus further comprising a needle rail which contains apertures, said needle rail apertures permitting the sewing needle and hook needle to pass therethrough and into the block section.

11. The apparatus of claim 10 wherein a longitudinal slot is provided in each of the sewing saddles, said slots facing the needle rail and containing inserts which terminate in a sharp edge and serve to center the spines of the book block sections carried by said saddles, said inserts being spaced from one another in order to permit the sewing needles and hook needles to pass into said slots without interference.

12. The apparatus of claim 11 further comprising a pressure plunger installed between each sewing needle and its associated hook needle, the plungers being movable against the spines of the book block sections to compress said spines against the saddles.

13. The apparatus of claim 10 wherein the endless conveyor circulates continuously and the support means for the sewing saddles offset said sewing saddles inwardly with respect to the continuous path defined by said conveyor, the articulation of the sewing saddles to the conveyor producing a dwell in the movement of the sewing saddles when they reach their upper reversal position beneath the sewing head in the said head operating area.

14. In a process for thread-sewing book blocks which are formed by linking together individual book block sections by sewing, the sewing being accomplished in a sewing zone through the use of sewing needle and cooperating hook needles, the sewing needles carrying a sewing thread through the fold of a partially opened block section whereupon the thread is transferred to a hook needle which draws the thread back through the block section spin in the form of a loop which is linked to a previously formed loop on an adjacent block section, the improvement comprising transferring the sewing threads directly from the sewing needles without thread grippers and pushers to the hook needles after the sewing needles have carried the threads through the spine of a given indivivdual book block section.

15. The process of claim 14 further comprising the step of causing the sewing needles to form apertures in the block section folds, the thread and sewing needles passing through said apertures and wherein the step of transferring includes causing the sewing needles to pivot within the said needle formed apertures, the pivoting movement being in the direction of the hook needle associated with the pivoted sewing needle.

16. The process of claim 15 fur:her comprising the step of compressing the spines of the book block sections before they are penetrated by the sewing needles and hook needles.

17. The process of claim 16 further comprising imparting a dwell time to the book block sections in the sewing zone, said dwell time being greater than one half the length of the cycle time of the sewing needles.

18. The process of claim 15 further comprising imparting a dwell time to the book block sections in the sewing zone, said dwell time being greater than one half the length of the cycle time of the sewing needles.

19. The process of claim 14 further comprising the step of compressing the spines of the bookblock sections before they are penetrated by the sewing needles and hook needles.

20. The process of claim 14 further comprising imparting a dwell time to the book block sections in the sewing zone, said dwell time being greater than one half the length of the cycle time of the sewing needles.

21. The process of claim 14 wherein the step of directly transferring comprises causing the direction of motion of the free ends of the sewing needles to change after said ends have pierced through the block section whereby the sewing needles will intersect planes in which their associated hook needles move.

* * * * *